United States Patent [19]

Gootzait et al.

[11] 4,337,030

[45] Jun. 29, 1982

[54] SOLID FUEL FIRED KILN

[75] Inventors: Edward Gootzait, Lewisburg; Donald L. Fisher, Milton, both of Pa.

[73] Assignee: Kennedy Van Saun Corporation, Danville, Pa.

[21] Appl. No.: 126,310

[22] Filed: Mar. 3, 1980

[51] Int. Cl.[3] ..... F27B 15/00

[52] U.S. Cl. ..... 432/14; 110/261; 110/264; 110/265; 110/347; 110/262

[58] Field of Search ..... 110/264, 265, 262, 347, 110/261, 262; 431/9, 284, 285, 115, 116; 432/14

[56] References Cited

U.S. PATENT DOCUMENTS

| | | | |
|---|---|---|---|
| 1,734,665 | 11/1929 | Frisch | 110/263 |
| 2,935,128 | 5/1960 | Ferguson | 431/284 |
| 3,221,796 | 12/1965 | Nesbitt | 431/285 |
| 4,241,673 | 12/1980 | Smith et al. | 110/264 X |
| 4,289,482 | 9/1981 | Fussl | 432/14 X |

*Primary Examiner*—Edward G. Favors

*Attorney, Agent, or Firm*—Brumbaugh, Graves, Donohue & Raymond

[57] ABSTRACT

A fuel burning kiln and process especially adapted for utilizing solid fuel in which one or more burners are accommodated within the kiln and a fuel and air mixture and a supplementary air supply are supplied to the combustion chamber of the burner through a pair of conduits arranged in heat exchange relationship one inside the other.

10 Claims, 4 Drawing Figures

SOLID FUEL FIRED KILN

This invention relates to a novel kiln system and process and a novel burner for use therein.

In conventional kiln systems and processes, fuel and air are introduced into the kiln proper to support combustion within the kiln. In the kiln system and process of the present invention, the burners within the kiln are each provided with their own pre-combustion chamber to ignite and initiate a controlled combustion therein before disseminating the fuel to the kiln proper for combustion therein. Toward this end, a mixture of fuel and air is supplied in a pneumatic stream to the burner's combustion chamber where the air component of the pneumatic stream supports partial combustion of the fuel. In addition, a stream of supplementary air is supplied to the burner's combustion chamber through a passage which is in heat exchange relationship with the passage which supplies the fuel and air mixture. This supplementary stream of air serves both as a coolant to prevent damage to the burner and as a supplementary supply of combustion air to the combustion chamber within the burner. The unburned fuel and air and the combustion gases are then directed into the kiln proper where a source of primary air supports the main combustion within the kiln.

The novel burner of the present invention embodies, inter alia, a pair of conduits in heat exchange relationship, preferably concentric conduits, which communicate with the upper region of the combustion chamber of the burner. The fuel and air mixture is supplied through one of the conduits and the supplementary air is supplied through the other of the conduits. Auxiliary fuel, for example, to assist in initially igniting the fuel, can also be supplied during start-up by the supplementary air conduit. The lower region of the combustion chamber is in open communication with the kiln proper to disseminate the fuel, air and combustion gases thereto.

The burner has been designed and is particularly adapted for the use of pulverized solid fuels, such as coal, in conventional systems and processes fired by gaseous or liquid fuels, such as propane, natural gas and oil. Since pulverized solid fuels are slower to ignite and burn than gaseous or liquid fuels, the retention time of the pulverized solid fuel within the burner and the distribution of the solid fuel particles present problems that are not encountered with the use of gaseous and liquid fuels. Toward this end, in a preferred embodiment of the burner, the fuel and air mixture supplied longitudinally through one of the conduits to the combustion chamber has impressed thereon the influence of a swirling stream, such as fuel and air or air alone, to obtain greater distribution of the fuel particles and increase the retention time of the particles within the burner.

Wider distribution and dissemination of the fuel particles within the kiln can also be achieved by spreading out the flow of the fuel, air and combustion gases within the combustion chamber of the burner by providing flow passages through the wall defining the combustion chamber and by spacing the discharge end of the fuel-/air conduit within the supplementary air conduit and above the upper region of the combustion chamber. Since the structure of the burner and the stream of flow through the combustion chamber thereof will tend to produce a toroidal low pressure zone around the outer periphery of the upper region of the combustion chamber, greater circulation of the stream is achieved by the tendency for at least part of the outwardly flowing stream to reverse direction and return through the apertured wall under the influence of the low pressure zone.

For a complete understanding of the invention, reference can be made to the detailed description which follows and to the accompanying drawings, in which.

Figures 2, 3, 4:
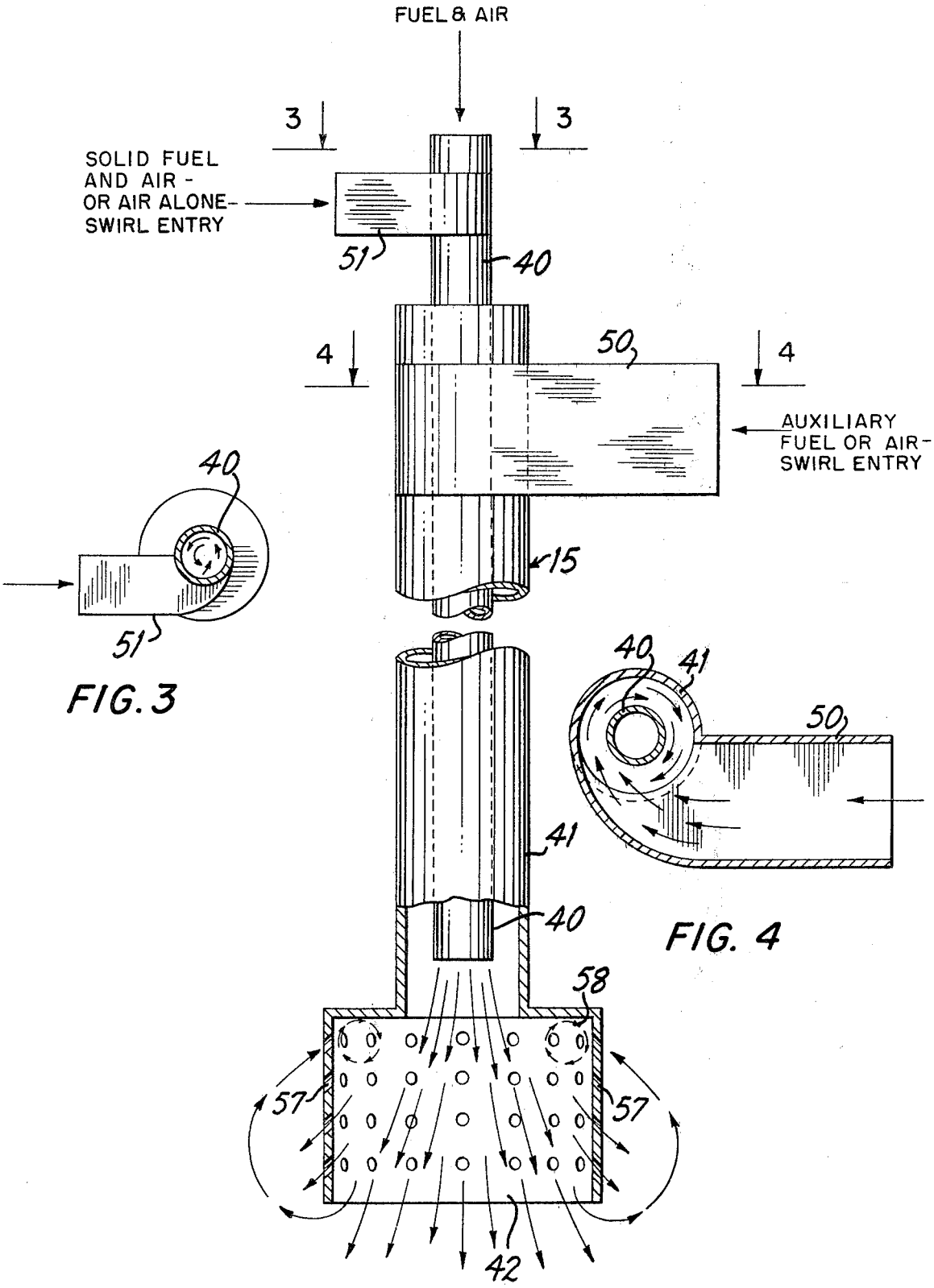
FIG. 2 is an elevational view partly in cross-section of the burner.

FIGS. 3 and 4 are sectional views taken along the lines 3—3 and 4—4, respectively, of FIG. 2 looking in the direction of the arrows.

Figure 1:
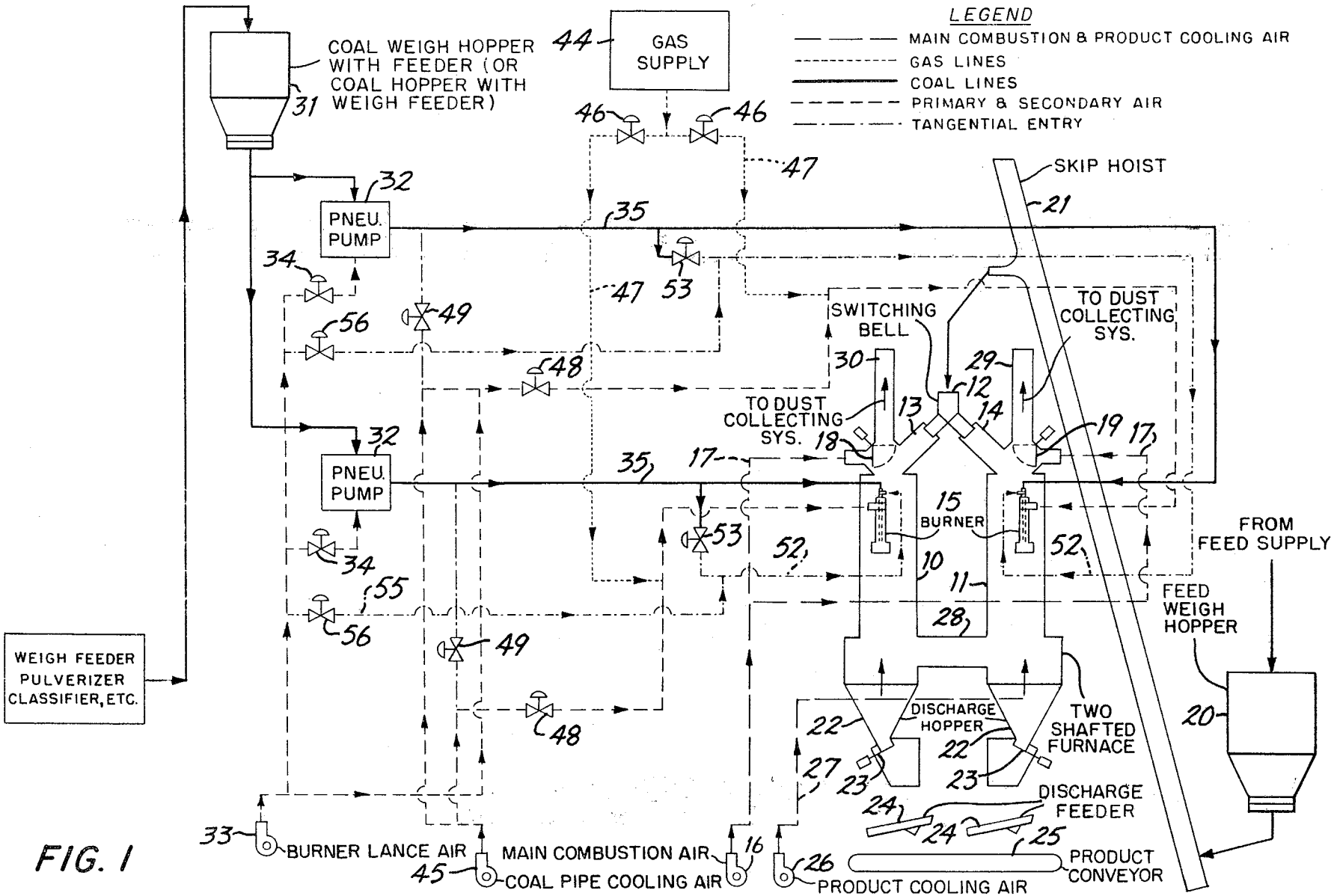
FIG. 1 is a schematic view of a coal-fired kiln system embodying the present invention.

A lime calcining system embodying the present invention, as illustrated in FIG. 1 of the drawings, includes a pair of kilns 10, 11 in parallel relation and having a common inlet 12. The structure and operation of the twin kilns are conventional and are described in the Schmid et al. U.S. Pat. No. 3,074,706, issued Jan. 22, 1963.

The limestone to be treated in the kilns is introduced into the common inlet 12 and is alternately charged at intervals into the upper preheating zones of the kilns 10 or 11 by a switching bell within the inlet 12. When the switching bell is in one position, the material is introduced through a conduit 13 into the kiln 10, and when the switching bell is in another position, the material is introduced through a conduit 14 into the kiln 11.

The kilns 10, 11 each contain a plurality of burners for heating the limestone. To simplify the drawing and description, duplication of burners, fuel and air conduits thereto and the supply blowers have been eliminated. The structure and operation of the burners will be described in more detail below in connection with FIGS. 2 through 4 of the drawings.

The main or primary air supply to support combustion is supplied from a blower 16 through conduits 17 to the kilns 10, 11. This primary air supports combustion within the kiln and the combustion gases flow downwardly and are ultimately discharged from the upper region of the other kiln. When the kiln 10 is in operation, the primary air is supplied to the kiln 10 through an open valve 18 in the upper region of the kiln. During this operation the valve 19 in the upper region of the kiln 11 is closed so that primary air is not supplied to it. When the kiln 11 is in operation, the valve 18 is closed and the valve 19 is open.

The limestone is supplied to the inlet 12 from a weighing hopper 20 via a skip hoist 21. As the lime descends through the kilns 10, 11, it passes through an upper preheating zone in each kiln, then through an intermediate burning zone and finally into a lower cooling zone. The cooled calcined lime is ultimately discharged from discharge hoppers 22 at the bottoms of the kilns through airtight doors 23 which are closed during the burner cycles of the kilns and opened during the reversing cycles of the kilns. The calcined lime is discharged onto feeders 24 which deliver it onto a product conveyor 25.

Product cooling air is supplied continuously to the lower regions of the kilns 10, 11 from a blower 26 through a conduit 27. The cooling air passes upwardly through the lower regions of the kilns. When the burners in the kiln 10 are in operation, the upwardly flowing cooling air supplied to the lower region of the kiln 10 joins with the downwardly flowing combustion gases in the kiln 10 and passes through a connecting conduit 28 between the lower regions of the kilns 10, 11. These gases then flow upwardly through the kiln 11 along with the cooling air supplied to the lower region of the kiln 11.

When the kiln 10 is in operation, the kiln 11 functions as a flue stack to heat fresh limestone introduced into the upper region of the kiln 11. The gases are discharged from the kiln 11 through a stack 29 which carries the gases to a dust collection system for removing limestone particles. Similarly, when the burners of the kiln 11 are in operation, the cooling air introduced into the lower region of the kiln 11 joins with the downwardly flowing combustion gases in the kiln 11 and crosses over to the kiln 10 through the connecting passage 28. These gases join the upwardly flowing cooling air introduced into the lower region of the kiln 10 and are discharged from the upper region of the kiln 10 through a stack 30 which carries the gases to the dust collection system.

In operation, one kiln burns the fuel while the other kiln serves as a flue stack. The limestone is charged into the upper region of the flue stack where it is preheated by the combustion gases from the other kiln and by the cooling air which has become heated by the time it reaches the upper region of the flue stack.

The coal supplied to the kilns passes through preparation equipment, for example, crushers, pulverizers and weighing and classifying equipment, which are not part of the present invention, and ultimately the pulverized coal is stored in a hopper 31 from which it is supplied in measured amounts to the kilns 10, 11. The coal will enter the feed system for one kiln while the other is in its burn period. The measured amounts of coal supplied to the kilns can be changed from one cycle to the next according to the heat requirements of the kilns.

A pneumatic feed system supplies the pulverized coal to the burners. Since the kilns are pressurized, that is, they operate at pressures greater than atmospheric pressure, all the passages entering the kilns operate under pressure. Toward this end, the coal is supplied to the kilns from the hopper 31 by pneumatic pumps 32, such as screw pumps, batch pumps or other pneumatic devices. The coal will be entrained at the pumps by air supplied from the blower 33 through regulating valves 34. The pulverized coal is carried in air streams to the burners in the kilns 10, 11 through conduits 35. The air stream supplies up to approximately one-third of the air needed for complete combustion.

In all probability all the burners in a kiln will not require equal amounts of fuel. The heat transfer and flow characteristics of the kiln will dictate the placement of the burners in the kiln and the flow rates to the burners. The flow of solid fuel to each burner can be controlled by the combination coal hopper and weigh feeder (or coal weigh hopper and feeder) 31. This will permit regulation of the coal feed from burn period to burn period or during a burn period.

The burners 15, as best shown in FIGS. 2 through 4, each comprise a pair of conduits 40, 41 in heat exchange relationship with each other and which communicate at their lower ends with a combustion chamber 42. The conduits are preferably concentrically arranged with the combustion chamber formed at the lower end of the outer conduit 41 by a depending wall 43. The lower discharge end of the inner conduit is spaced within the outer conduit and above the upper region of the combustion chamber.

The upper intake end of the inner conduit 40 communicates with one of the coal/air supply conduits 35 and the mixture flows longitudinally through the conduit 40 into the combustion chamber. The upper intake end of the outer conduit 41 communicates with a supply 44 of auxiliary fuel, such as propane, natural gas or oil, and also with an air supply from a blower 45, so that auxiliary fuel, a mixture of auxiliary fuel/air or air alone can be supplied to the conduit 41 and introduced thereby into the combustion chamber.

The auxiliary fuel is normally required only during start-up. The hot beds within the kilns provide adequate heat to ignite the coal at the start of each burning period. Nevertheless, the auxiliary fuel is available in the event of operating difficulties during burning periods when for one reason or another ignition or additional heat is required. When the auxiliary fuel is not needed, the supply thereof can be shut off from the burner by closing the fuel regulating valves 46 in the fuel lines 47.

The air supplied to the outer conduit 41 serves the dual function of providing supplementary air to support combustion within the combustion chamber and providing a coolant in order to prevent damage to the burner. The supply thereof can be controlled by the air regulating valves 48.

The discharge of the blower 45 also communicates with the coal/air supply conduits 35 through valves 49 in the event that it is desirable to supplement the air supply in these conduits. Normally, however, the valves 49 would remain closed.

The auxiliary fuel and/or air is supplied to the upper end of the outer conduit 41 through a tangential inlet 50 which imparts a swirling helical motion to the stream as it passes downwardly through the annular passage to the combustion chamber 42. This swirling motion helps distribute the auxiliary fuel and air when such mixture is introduced in the conduit. More importantly, it maximizes the time retention of the cooling air flowing therethrough when air alone is introduced so as to obtain maximum cooling effect and at the same time preheat the air before it is introduced into the combustion chamber.

In addition to the coal/air mixture supplied longitudinally through the inner conduit 40, it is possible to supply a swirling stream of coal/air mixture or air alone into the upper end of the conduit 40 through a tangential inlet 51. The tangential inlet 51 of each burner is connected by a conduit 52 through a valve 53 to the respective coal/air supply conduit 35. When the valves 53 are closed the entire coal/air mixture is introduced longitudinally into the upper inlet end of the inner conduit 40. When it is desired to introduce at least part of the coal/air mixture tangentially into the inner conduit 40 to distribute the coal/air mixture more effectively and slow down its passage through the inner conduit 40, this can be accomplished by opening the regulating valves 53.

It is also possible to introduce swirling air alone into the tangential inlet 51 of the inner conduit 40. Toward this end, the conduits are connected downstream of the valves 53 through conduits 55 to the blowers 33. A valve 56 in each of the conduits 55 establishes, shuts off or regulates the flow of air to the conduits 52. By closing the valves 53 and opening the valves 56, air alone will be introduced into the tangential inlets 51.

The mixing of the coal particles into the air increases the combustion efficiency in that it better distributes the coal particles and enables them to be brought to the desired temperature and concentration levels in less time. Also, by providing a separate combustion chamber for each burner a substantial amount of the coal is ignited and consumed even before entering the kiln proper.

The hot, partially burned solid material will have a tendency to flow downwardly through the open bottom of the combustion chamber. In order to help spread the heat over a greater cross-section of the bed, a plurality of downwardly extending passages 57 are provided in the wall 43 to permit the unburned coal particles and the hot combustion gases to leave the burner at oblique angles and penetrate the bed around the burners as well as beneath the burners.

The axial distance from the discharge end of the conduit 40 to the surface of the wall 43 where the flow impinges on the wall can be controlled by controlling the rates of flow through the conduits 40 and 41. The flow stream creates a toroidal low pressure zone 58 around the outer periphery of the upper end of the combustion chamber. This low pressure zone, in turn, tends to return some of the gases back to the low pressure region of the combustion chamber. Thus, the lower passages 57 tend to direct flow outwardly into the kiln bed and the passages in the upper region of the wall tend to serve as re-entry passages to permit flow of the hot kiln gases to the chamber.

The burners are dispersed throughout the bed of limestone at levels such that the lower discharge ends thereof are about one-third of the distance down from the top of the kiln, thereby defining the lower end of the preheating zone and the upper end of the combustion or burning zone.

In the operation of a multiple column vertical kiln having a capacity in the order of 400 metric tons per day, the heat required for the calcination of the limestone will be in the order of about 3.64 to $10^6$ BTU per metric ton, requiring a firing system capability of about $70\times10^6$ BTU per hour.

Although the system and process may be adapted for any fuel, it is particularly adapted for pulverized coal. The coal employed is preferably Hardgrove 50 of a size 1" or less and having a moisture content not greater than 15%. The coal is milled or pulverized at the rate of about 3.5 tons per hour to a grind in which 85% is less than 200 mesh and the moisture content is less than 2%. The coal rate flow per burner should be in the order of about 390 pounds per hour carried by an air flow stream in the order of 40 standard cubic feet per minute. Additional air necessary to support combustion in the burner, whether supplied through the conduits 40 or 41, should be in the order of about 148 standard cubic feet per minute at 8 pounds per square inch gauge. Additional air necessary to support combustion in the kiln proper is supplied as needed.

The invention is shown and described in a single preferred form and by way of example, and many modifications and variations may be made therein within the scope of the invention. The invention, therefore, is not intended to be limited to any specific form or embodiment except in so far as such limitations are expressly set forth in the claims.

We claim:

1. A fuel burner comprising means defining a pre-combustion chamber having a lower region which is in communication with the combustion chamber of the kiln, an outer conduit communicating at its lower end with the upper region of the pre-combustion chamber and extending upwardly within the kiln, an inner conduit within the outer conduit and having its lower discharge end within the outer conduit and spaced above the upper region of the pre-combustion chamber, pneumatic feed means for supplying a pulverized solid fuel and air mixture to the inlet end of said inner conduit and for discharging the mixture into the pre-combustion chamber, the air in the mixture supporting at least partial combustion of the solid fuel particles within the pre-combustion chamber, means for supplying air to the outer conduit for cooling the conduits and supporting combustion within the pre-combustion chamber, means for supplying an air supply to the combustion chamber of the kiln proper to support combustion outside the pre-combustion chamber, and an apertured depending wall forming part of the pre-combustion chamber for discharging at least part of the stream from the inner conduit through the apertures, thereby forming a lower pressure toroidal zone in the upper region of the pre-combustion chamber around the outer periphery thereof for inducing flow into the pre-combustion chamber.

2. A fuel burning process comprising the steps of pneumatically feeding a fuel and air mixture into a pre-combustion chamber of a burner within the combustion chamber of a kiln through an inner conduit, flowing the stream from the discharge end of the inner conduit outwardly through the outer wall of the pre-combustion chamber to define a toroidal low pressure region in the outer periphery of the upper region of the pre-combustion chamber, the air supporting at least partial combustion of the fuel within the pre-combustion chamber, supplying air to the kiln proper to support combustion within the combustion chamber of the kiln, swirling a stream of air around the inner conduit and through an outer conduit to cool the conduits and supply combustion air to the pre-combustion chamber, and flowing a stream through the outer wall of the pre-combustion chamber to the low pressure region of the pre-combustion chamber.

3. In a kiln into which air and combustion gases are introduced for maintaining combustion in the kiln to calcine limestone therein, a fuel burner for initiating combustion therein and supplying combustion gases to the kiln comprising a burner pre-combustion chamber within the kiln and in open communication at one end with the combustion chamber of the kiln, an outer conduit in heat exchange relation with the combustion chamber of the kiln for supplying supplementary air to the pre-combustion chamber, an inner conduit within and insulated from the heat of the kiln by the outer conduit and the cooling effect of the supplementary air for supplying a flow of fuel and air mixture to the pre-combustion chamber, means for establishing communication between the outer conduit and a source of auxiliary fuel and means for shutting off the supply of auxiliary fuel.

4. In a kiln into which air and combustion gases are introduced for maintaining combustion in the kiln to calcine limestone therein, a fuel burner for initiating combustion therein and supplying combustion gases to the kiln for further combustion within the kiln comprising a burner pre-combustion chamber within the kiln and in open communication at one end with the combustion chamber of the kiln, the pre-combustion chamber being formed in part by an apertured wall to supply combustion gases to the kiln through both the apertures and the open end of the pre-combustion chamber, an outer conduit in heat exchange relation with the combustion chamber of the kiln for supplying supplementary air to the pre-combustion chamber and an inner conduit within and insulated from the heat of the kiln by the outer conduit and the cooling effect of the supplementary air for supplying a flow of fuel and air mixture to the pre-combustion chamber.

5. A fuel burner as set forth in claim 4 including a wall opposite the open end of the pre-combustion chamber and cooperating with the apertured wall to define the pre-combustion chamber, and an opening therein which communicates with the discharge end of the outer conduit, the outward flow of combustible products from the conduits through the apertured wall of the pre-combustion chamber forming a low pressure zone around the outer periphery of said wall which permits a flow of hot gases from the kiln through the apertured wall into the low pressure region of the pre-combustion chamber.

6. A fuel burner as set forth in claim 4 in which at least a plurality of apertures through the depending wall extend diagonally outwardly in a downstream direction.

7. In a kiln into which air and combustion gases are introduced for maintaining combustion in the kiln to calcine limestone therein, a fuel burner for initiating combustion therein and supplying combustion gases to the kiln for further combustion within the kiln comprising a burner pre-combustion chamber within the kiln and in open communication at one end with the combustion chamber of the kiln, an outer conduit in heat exchange relation with the combustion chamber of the kiln for supplying supplementary air to the pre-combustion chamber, an inner conduit within and insulated from the heat of the kiln by the outer conduit and the cooling effect of the supplementary air for supplying a flow of fuel and air mixture to the pre-combustion chamber, an axial inlet to said inner fuel/air conduit for the fuel/air mixture and a tangential inlet for introducing a swirling stream therein.

8. A process for introducing combustible materials into the combustion chamber of a kiln for calcining limestone therein comprising the steps of supplying a fuel and air mixture through an inner conduit which passes into the combustion chamber of the kiln and communicates with a pre-combustion chamber of a burner accommodated within the kiln to initiate combustion within the pre-combustion chamber, introducing a swirling stream into the inner conduit, supplying supplementary air through an outer conduit which encompasses the inner conduit and separates it from the combustion chamber of the kiln, cooling and insulating the inner conduit from the heat of the combustion chamber of the kiln while supplying supplementary air to the pre-combustion chamber, and supplying the burning mixture from the pre-combustion chamber of the burner to the combustion chamber of the kiln through the open end of the pre-combustion chamber.

9. A process for introducing combustible materials into the combustion chamber of a kiln for calcining limestone therein comprising the steps of supplying a fuel and air mixture through an inner conduit which passes into the combustion chamber of the kiln and communicates with a pre-combustion chamber of a burner accommodated within the kiln to initiate combustion within the pre-combustion chamber, supplying supplementary air through an outer conduit which encompasses the inner conduit and separates it from the combustion chamber of the kiln, cooling and insulating the inner conduit from the heat of the combustion chamber of the kiln while supplying supplementary air to the pre-combustion chamber, supplying the burning mixture from the pre-combustion chamber of the burner to the combustion chamber of the kiln through the open end of the pre-combustion chamber, flowing the combustible material through an apertured wall of the pre-combustion chamber to define a low pressure region in the outer periphery of the pre-combustion chamber remote from the open end thereof and flowing a stream through the apertured wall of the pre-combustion chamber to the low pressure region therein.

10. A process as set forth in claim 9 including discharging the fuel and air mixture from the inner conduit into the outer conduit upstream of the pre-combustion chamber.

* * * * *